United States Patent [19]

Boucherie Leonel P.

[11] 4,360,236

[45] Nov. 23, 1982

[54] DOUBLE FIBRE MAGAZINE FOR BRUSH MANUFACTURING MACHINES

[75] Inventor: Boucherie Leonel P., Roeselare-Rumbeke, Belgium

[73] Assignee: Firma G.B. Boucherie, Naamloze Vennootschap, Izegem, Belgium

[21] Appl. No.: 132,844

[22] Filed: Mar. 24, 1980

[30] Foreign Application Priority Data

Mar. 24, 1979 [DE] Fed. Rep. of Germany ..... 2911668

[51] Int. Cl.[3] ..... A46D 1/08

[52] U.S. Cl. ..... 300/9

[58] Field of Search ..... 300/1, 2, 4, 7, 9, 19; 222/144.5

[56] References Cited

U.S. PATENT DOCUMENTS 3,107,945 10/1963 Whitman et al. ..... 300/2

3,140,122 7/1964 Spiegel ..... 300/2

3,215,472 11/1965 Zahoransky ..... 300/7

FOREIGN PATENT DOCUMENTS 1028969 4/1958 Fed. Rep. of Germany ..... 300/7

*Primary Examiner*—Howard N. Goldberg

*Attorney, Agent, or Firm*—Bacon & Thomas

[57] ABSTRACT

The invention pertains to a double fibre magazine for brush manufacturing machines, characterized in that it mainly consists of a combination of two fibre magazines which are immovably located opposite to the bundle plucker, each fibre magazine being provided with a separating device and a pressing component for pressing the fibres towards the bundle plucker; and means which alternately put the fibres beyond the reach of the bundle plucker in one and the other fibre magazine.

3 Claims, 7 Drawing Figures

Fig. 1
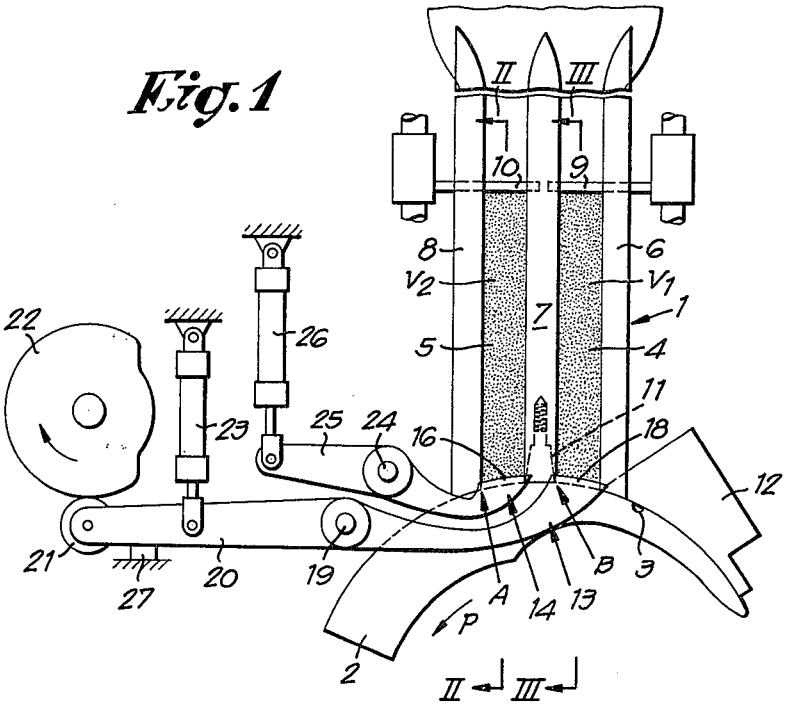
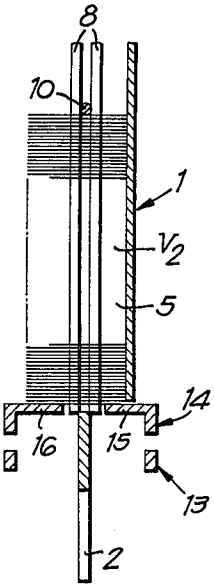
Fig. 2
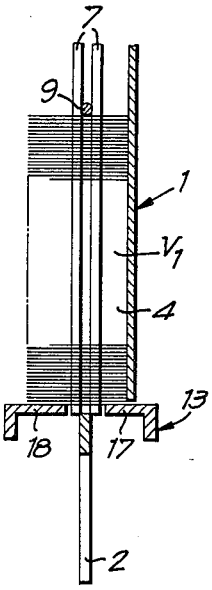
Fig. 3
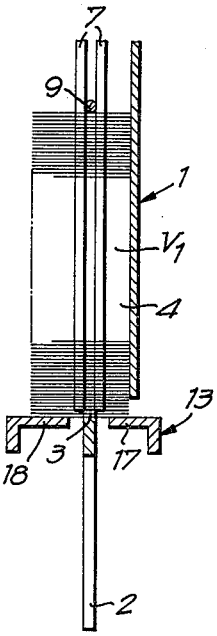
Fig. 5
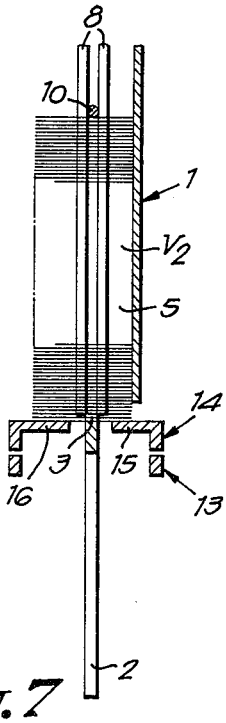
Fig. 7

DOUBLE FIBRE MAGAZINE FOR BRUSH MANUFACTURING MACHINES

The present invention relates to a double fibre magazine as used on brush manufacturing machines whenever either differently coloured fibres or fibres made from different materials or with different compositions have to be dealt with.

Suchlike double fibre magazines are already known but, in relation to the so called bundle plucker, which must take off the fibres, per bundle, from the double fibre magazine, these fibre magazines are either hinged or slidably mounted; in other words, depending on the fibres which are needed at a certain moment, the double fibre magazine is always turned over backwards and forwards around an appropriate axis, in order to place the required fibre magazine above the aforesaid bundle plucker.

The drawback attached to a suchlike known hinged magazine is that the speed of the brush manufacturing machine is limited, resulting in high speeds being impossible to attain.

As a matter of fact, a great drawback of these known double fibre magazines is that the great mass of a suchlike fibre magazine is to be moved on a comparatively great distance, resulting in the speed of the machine being limited.

Consequently, the object of the present invention is a double fibre magazine which is such that the fibres can be plucked at will from one or from the other magazine, even at very high speeds, because, combined with the stationary fibre magazine along which the bundle plucker moves, means are provided, having only a minute mass and having to be moved only on a small distance for putting the fibres of one or the other magazine beyond the reach of the bundle plucker, so that, owing to this, as compared with machines equipped with the known double fibre magazine, a much higher speed can be obtained.

The double fibre magazine according to the invention that has the aforesaid and other advantages consists for this purpose in the combination of two fibre magazines which are immovably located opposite to the bundle plucker, each fibre magazine being provided with a separating device and a pressing component for pressing the fibres towards the bundle plucker; and means which alternately push the fibres of one or the other magazine beyond the reach of the bundle plucker.

In order to throw more light on the characteristics of the invention, a preferred embodiment will be described hereinafter, as an example without any limiting character, reference being made to the attached drawings, in which:

FIG. 1 shows a front view of a double fibre magazine according to the invention;

FIGS. 2 and 3 are respectively sections according to the lines II—II and III—III in FIG. 1;

FIG. 5 is a section according to the line V—V in FIG. 4;

FIG. 7 is a section according to line VII—VII in FIG. 6.

Figure 4:
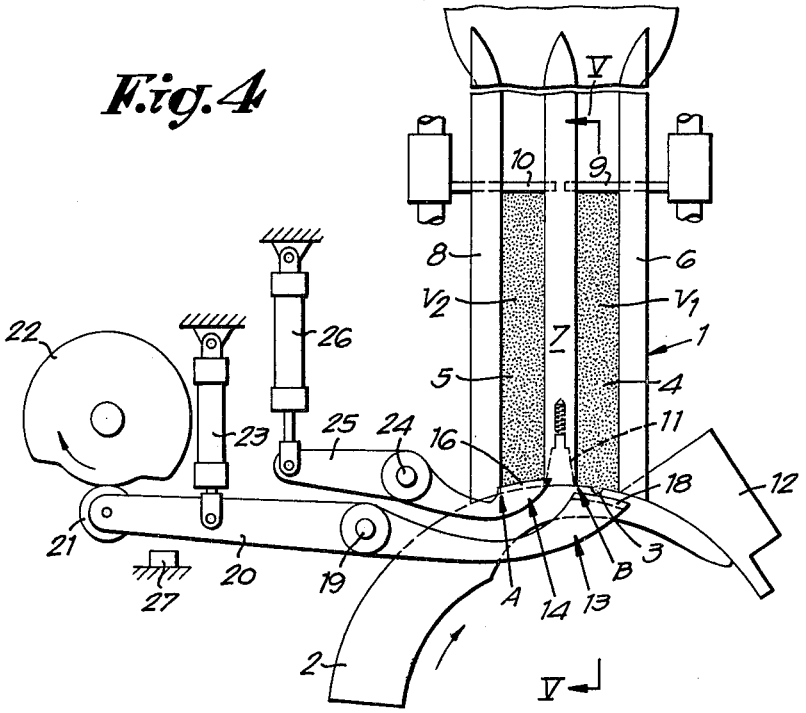
FIG. 4 is a view similar to the one of FIG. 1, but in another characteristic position.

As shown in the attached drawings, the double fibre magazine according to the invention mainly consists of the magazine proper 1, along which the bundle plucker 2 can pass in order successively to take off bundles of fibres in the recess 3, either from the magazine 4 or from the magazine 5. In the present case, the fibre magazine 1 consists of three pairs of supports or guides, respectively 6, 7 and 8, whilst between these pairs of guides pressing components, respectively 9 and 10, can be moved in order continuously to exert an appropriate pressure on the fibres, respectively V1 and V2 that are contained in the magazines 4 and 5.

Between the fibre magazines 4 and 5, there is a schematically drawn stripper component 11, which ensures that the quantity of fibres taken from the magazine 5 by the recess 3 is correctly separated, in other words, component 11 ensures that no more fibres are plucked than can be contained in the recess 3, whilst between the supports 6 of the double fibre magazine a separating component 12 is provided which has the same function for the fibres that are being plucked from the fibre magazine 4.

According to the present invention, under each fibre magazine, 4 and 5, there are provided forked pushing components, 13 and 14, which, are positioned below the fibres V1, respectively V2, and are made in such a way that they each define two planes 15, 16 and 17, 18, by means of which the fibres V1, respectively V2, can be pushed upwards.

The pushing component 13 is rotatably mounted on a shaft 19 and is provided beyond this shaft with an extension 20 carrying a roller 21 which is apt to cooperate with a cam 22, on the one hand, whilst the aforesaid extension is also hinged to a pressure cylinder 23, which itself is hinged to a fixed part of the machine, on the other hand.

The pushing component 14 is rotatably mounted on a shaft 24 and is provided beyond this shaft with an extension 25 which is hinged to a pressure cylinder 26 which itself is hinged to a fixed support of the machine.

The operation of the double fibre magazine according to the invention is very simple and as follows.

For taking fibres V1 from the magazine 4, the pushing component 14 will be moved upwards to the position as shown in FIG. 4, this being obtained by extending the pressure cylinder 26, wherethrough the fibres V2 of the magazine 5 will be put beyond the reach of the recess 3 in the bundle plucker 2, which moves backwards until it arrives in point A.

The lever 13 is also pushed up, by means of cam 22, in way of the fibres V1 until it arrives in the position shown in FIG. 1, in order to obtain that, in the backward motion, according to the arrow P, of the bundle plucker 2, the aforesaid recess 3 will not be capable of being filled with fibres V1 from the magazine 4, after which, once the recess 3 has come beyond the point B, the lever 13, by means of the cam 22, becomes lowered again, as shown in FIG. 4, so that at this moment the recess 3 of the backwards moving bundle plucker 2, can take fibres V1 from the magazine 4.

When the recess 3 is situated under the separator 12, the cam 22 will make the lever 13 push the fibres V1 upwards again, in order to put the fibres V1 beyond the reach of the recess 3 during the backward motion of the bundle plucker, and so on.

The up and down motion of the lever 13 is thus obtained through a cam 22, whilst the cylinder 23 is in the retracted position and can act as a spring for keeping the roller 21 constantly against the cam 22. It goes without saying that other means as a spring or a similar device can be used also.

For taking fibres V2 from the fibre magazine 5, it is enough in this case, by means of the cylinder 23, to move the lever 13 upwards so that the fibres V1 remain clear of the aforesaid recess 3, whilst it is possible for this purpose to have the extension 20 of the lever 13 cooperating for instance with an appropriate stop 27.

As long as fibres are being taken from the magazine 5, the lever 13 will be kept in this position.

Figure 6:
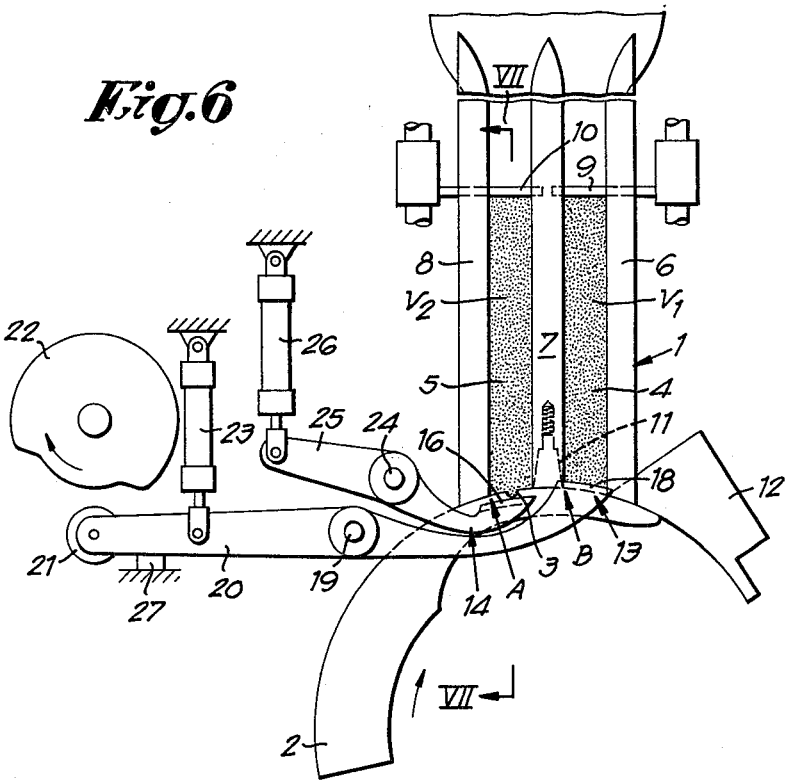
FIG. 6 is a view similar to the one of FIG. 1, but for a second characteristic position.

At this moment, the lever 14 will simply be moved down by retracting the cylinder 26, as shown in FIG. 6, this lever 14 remaining down as long as fibres V2 are being taken from the magazine 5.

Consequently, it is clear that at any moment, either fibres V1 can be taken from the fibre magazine 4 or fibres V2 from the fibre magazine 5, simply and solely by appropriately moving the levers 13 and 14, whilst it is not necessary to move the fibre magazine proper. By these means there is obtained that only small masses require to be moved on short distances for taking off fibres from another fibre magazine, so that, as compared with the known devices, considerably higher taking off speeds can be obtained, wherethrough the output of the machine equipped with a suchlike magazine is really higher than the output of the known machine in which two kinds of fibres are dealt with.

In another embodiment, the levers 13 and 14 can each be driven by means of a cam which is mounted on the so called template shaft for controlling the brush holders.

In this case, as is known, when the template shaft rotates, the brush holders are moved step by step from one hole in the brush body to another.

For each hole, the desired fibres V1 or V2 are then taken off because the aforesaid cams, which rotate in synchronism with the templates for the motion of the brush bodies, act on the pushing components 16–18.

The connection between the latter and cams can take place by means of small levers and/or connecting rods, whilst, for instance, springs may act on the small levers, keeping same against the cams, rollers being interposed.

A great advantage of this means of transmission is that such a purely mechanical forced control allows one to work at a very high speed.

It goes without saying that the present invention is not limited to the embodiment described as an example and shown in the attached drawings, but that such a fibre magazine can be made in various shapes and with various dimensions without going outside the scope of the invention.

What I claim is:

1. A brush stuffing machine including a stationary container with first and second compartments each having a discharge opening and containing stuffing material, a picker provided with a stuffing opening therein movable below said compartment discharge openings, each of said first and second compartments having means therein to push the stuffing material therein towards the corresponding discharge opening, a lifting device for each compartment adapted to raise said stuffing material when said picker stuffing opening is moving below the other compartment and is being filled with material from said other compartment, means to alternately operate said lifting devices, and first and second stripper devices adjacent said first and second compartments respectively and each adapted to strip stuffing material from said stuffing opening after it has been filled from said first and second compartment, respectively.

2. A brush stuffing machine as defined in claim 1, wherein said first and second lifting devices are each constituted by a fork-shaped lever having a widened end part able to operate on said material of said first and second compartment, respectively.

3. A brush stuffing machine as defined in claim 1, wherein said first stripping device is mounted between said first compartment and said second compartment, said second stripping device being mounted adjacent said second compartment, one of said lifting devices constituting a further stripping means which is operative during the movement of said picker between said first and second stripping devices.

* * * * *